US009581414B1

(12) United States Patent
Mironski

(10) Patent No.: US 9,581,414 B1
(45) Date of Patent: Feb. 28, 2017

(54) TACTICAL RETAINER BELT

(71) Applicant: Tomasz Boguslaw Mironski, Cameron, NC (US)

(72) Inventor: Tomasz Boguslaw Mironski, Cameron, NC (US)

( * ) Notice: Subject to any disclaimer, the term of this patent is extended or adjusted under 35 U.S.C. 154(b) by 0 days.

(21) Appl. No.: 15/188,196

(22) Filed: Jun. 21, 2016

(51) Int. Cl.
*F41C 33/04* (2006.01)
*A45F 5/02* (2006.01)
*A41F 9/02* (2006.01)

(52) U.S. Cl.
CPC ..... *F41C 33/046* (2013.01); *A41F 9/025* (2013.01); *A45F 5/021* (2013.01)

(58) Field of Classification Search
CPC ..... A45F 5/02; A45F 9/02; F41C 33/04
USPC ..... 224/660, 662, 664, 665
See application file for complete search history.

(56) References Cited

U.S. PATENT DOCUMENTS 1,911,824 A * 5/1933 Heller ..... A41F 9/02 24/163 R
2,241,298 A * 5/1941 Friedman ..... A41F 9/02 2/237
D259,151 S * 5/1981 Kishbaugh ..... 224/662
4,747,527 A * 5/1988 Trumpower, II ..... A41F 9/002 2/311
5,152,443 A * 10/1992 Hagan ..... A41F 9/002 224/148.4
5,379,491 A * 1/1995 Solo ..... A42B 1/247 224/901.2
5,464,136 A * 11/1995 Eddy ..... A45F 5/02 2/308
5,582,337 A * 12/1996 McPherson ..... A45F 3/14 224/660
5,586,969 A * 12/1996 Yewer, Jr. ..... A61F 5/028 128/101.1
5,683,022 A * 11/1997 Evans ..... A41F 9/002 224/583
5,722,576 A * 3/1998 Rogers ..... A45F 5/02 224/195
5,765,738 A * 6/1998 Hoffner ..... A45F 5/00 224/661
5,819,320 A * 10/1998 Jolla ..... A41F 9/00 2/227
5,881,933 A * 3/1999 Rogers ..... A41F 9/02 224/195
7,575,136 B2 * 8/2009 Kernkamp ..... A45F 3/14 224/158
7,752,722 B2 * 7/2010 Calkin ..... A41F 9/02 128/876
7,762,440 B2 * 7/2010 Cook ..... A45F 5/021 2/338
8,225,976 B2 * 7/2012 Meunier ..... A45F 5/02 224/672
8,998,053 B2 * 4/2015 Cromie ..... A45F 5/02 224/660
9,149,090 B1 * 10/2015 Taylor ..... A41F 9/02
9,339,102 B2 * 5/2016 Iosilevich ..... A45F 5/021
(Continued)

*Primary Examiner* — Brian D Nash
(74) *Attorney, Agent, or Firm* — Dunlap Bennett & Ludwig PLLC

(57) ABSTRACT

A Tactical retainer belt is disclosed. This invention allows for the correct fitment of any sidearm, any magazine, and any tactical accessories without the need to purchase additional gear or pouches, thus lowering long-term costs for the user. This system allows the user the ability to rapidly adjust to mission or job changes by accommodating any load out.

13 Claims, 7 Drawing Sheets

(56) References Cited

U.S. PATENT DOCUMENTS

| | | | | |
|---|---|---|---|---|
| 2003/0015905 | A1 | 1/2003 | Sappei et al. | |
| 2008/0190980 | A1* | 8/2008 | Overton | A45F 3/14 224/664 |
| 2009/0095783 | A1* | 4/2009 | Price | A45F 3/00 224/576 |
| 2009/0308900 | A1* | 12/2009 | Kernkamp | A45F 3/14 224/158 |
| 2010/0102096 | A1* | 4/2010 | Willows | A45F 5/00 224/148.1 |
| 2014/0075650 | A1 | 3/2014 | Garrison et al. | |

* cited by examiner

TACTICAL RETAINER BELT

BACKGROUND OF THE INVENTION

The present invention relates tactical gear, and more particularly to retaining belts for tactical gear.

Current holsters limit the ability to carry accessory items (e.g. flashlights, tourniquets, batteries, magazines). They also require the user to purchase model-specific holsters, magazine pouches, and accessory pouches. Current belts also require the user to remove their belt from belt loops in order to remove their holster and accessory pouches. Conventional holsters and accessory pouches offer little in the way of concealed compartments for storing sensitive items (e.g. identity documentation, money, keys, maps, small quantities of medicine). Conventional tactical systems are not built with the strength required to double as a climbing harness. Individuals require a separate harness in order to rappel or climb.

Other systems currently utilized are built for specific sidearm models, and all require the additional purchase of accessory pouches. None solve this issue and none can double as a climbing harness.

As can be seen, there is a need for a tactical retainer belt that allows for the correct fitment of any sidearm, any magazine, and any tactical accessories without the need to purchase additional gear or pouches, thus lowering long-term costs for the user. This system allows the user the ability to rapidly adjust to mission or job changes by accommodating any load out.

SUMMARY OF THE INVENTION

In one aspect of the present invention, a tactical belt includes a double layer outer belt having an inner web and an outer web, a first fastener layer attached to an outwardly facing surface of the inner web, a second fastener layer attached to an inwardly facing surface of the outer web, wherein the first and second fastener layers are releasably joined; an inner belt having a fourth fastener layer along an outwardly facing surface thereof for cooperative engagement with a third fastener layer along an inwardly facing surface of the inner web; and a buckle to join a first end and a second end of the outer belt. In some embodiments, the inner belt is adapted to be threadingly received through a belt loop of a user's pants.

In some aspects of the invention, the tactical belt may also include an insert having at least one sidewall defining a cavity therein; and a fastener layer attached to an exterior surface of the at least one sidewall, the fastener layer adapted to be received in a retention point defined between a separated portion of the inner web and the outer web. The insert is adapted to receive a tactical accessory, which may be a handgun, a flash light, a magazine.

In other embodiments of the invention, the tactical belt may be equipped with a comfort pad having a fastener material attached to and extending along an upper aspects of the comfort pad, wherein the comfort pad fastener material is configured to engage with a cooperating interior fastener layer attached to an outer surface of the inner belt.

In yet other aspects of the invention, the tactical belt may also be equipped with a harness assembly. The harness assembly may have a pair of leg straps forming a releasable loop adapted to encircle a user's leg. The leg straps are operatively attachable to the outer belt via a hook loop defined at a first end of the leg straps. In some embodiments, the leg straps include buckle to releasably join a second end of the leg straps at a point proximal the hook loop. The harness assembly may also include a back strap operatively connected between an intermediate portion of the leg strap and a midpoint of the comfort strap. The back strap may also be adjustable in length via one or more square rings. The back strap may be connected to the leg strap and the comfort strap via one or more b-rings operatively coupled via a loop of material sewn to the leg strap and the comfort strap. The leg straps are preferably attached to a common D-ring operatively attached to the comfort strap. In some embodiments, the second end of the leg strap is fitted with a buckle and is configured for cooperative engagement with a corresponding buckle operatively attached to an intermediate portion of the leg strap proximal to the belt slot. In other embodiments, a comfort cover is formed as a padded sleeve to cover at least an aft portion of the leg straps.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tactical belt assembly having a plurality of adjustable retention points, for the secure carriage of tactical equipment retained by the belt.

A user can utilize the system of the present invention in order to avoid purchasing multiple holsters, magazine pouches and accessory pouches for concealed carry or combat. An individual in the military, police force, or civilian sector can use this system to rapidly respond to changing mission requirements or job load outs without the need to purchase additional items. This tactical retaining belt enables personnel to quickly and efficiently organize and carry any sidearm(s), magazines or tactical accessories (e.g. flashlights, sharps, tourniquets, electronics etc.) and affords personnel the ability to quickly and rapidly remove all equipment by removing the entire load out as one piece. In addition, this system affords personnel the ability to climb or rappel with the use of attachable leg straps, circumventing the necessity of purchasing or using a separate climbing harness.

Figure 1:
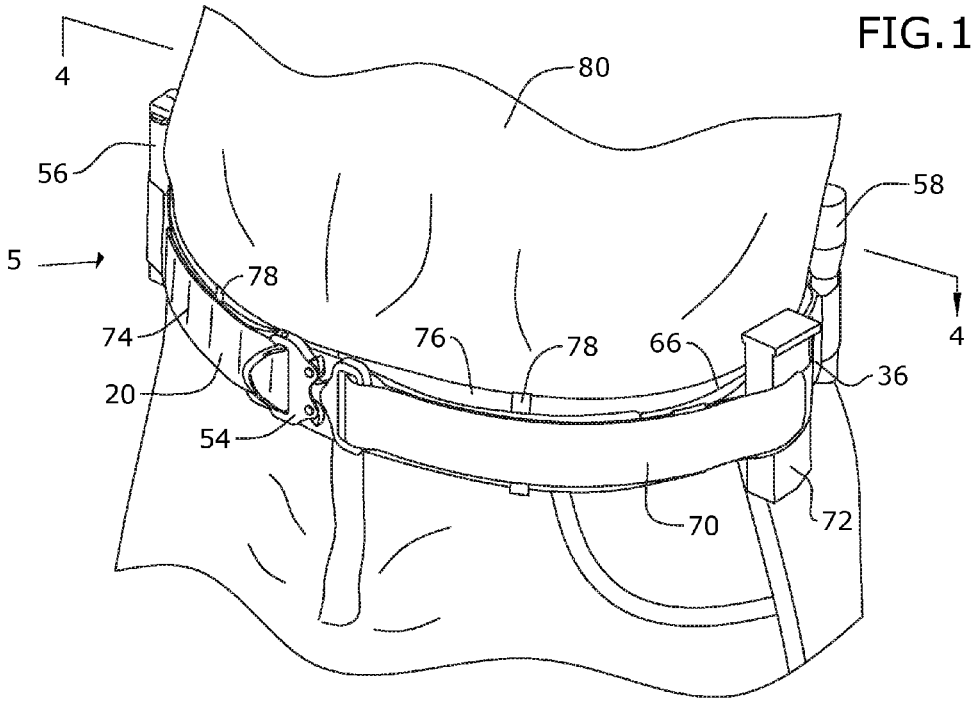
FIG. 1 is a front perspective view of an embodiment of a tactical belt shown in use.
Figure 2:
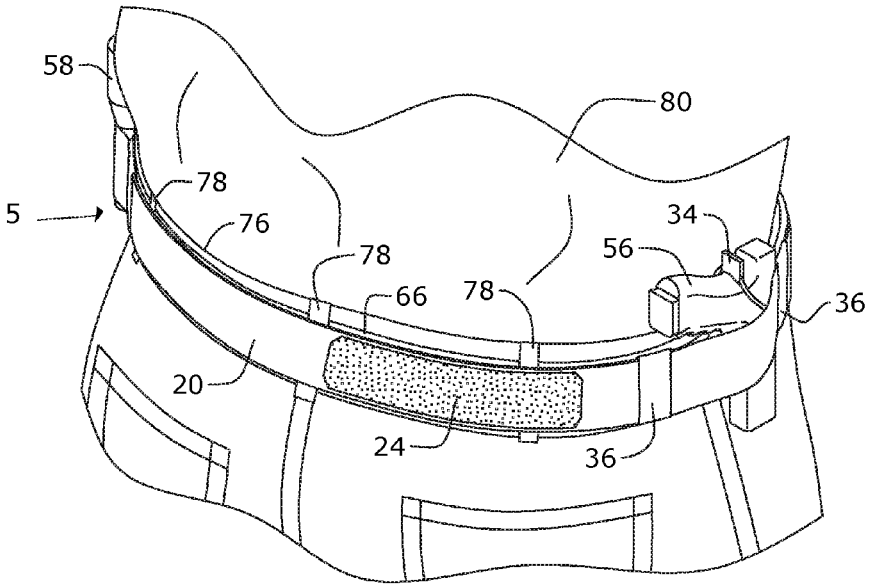
FIG. 2 is a back perspective view of the tactical belt shown in use.

As seen in reference to FIGS. 1 and 2, a belt assembly 5 is illustrated worn by a user 80. The belt assembly 5, may be utilized to conveniently and securely carry a plurality of tactical items, such as: a pistol 56, or like firearm; a magazine 72; a flashlight 58; and the like. It also serves as a base upon which to attach additional items, such as a repelling harness.

Figure 3:
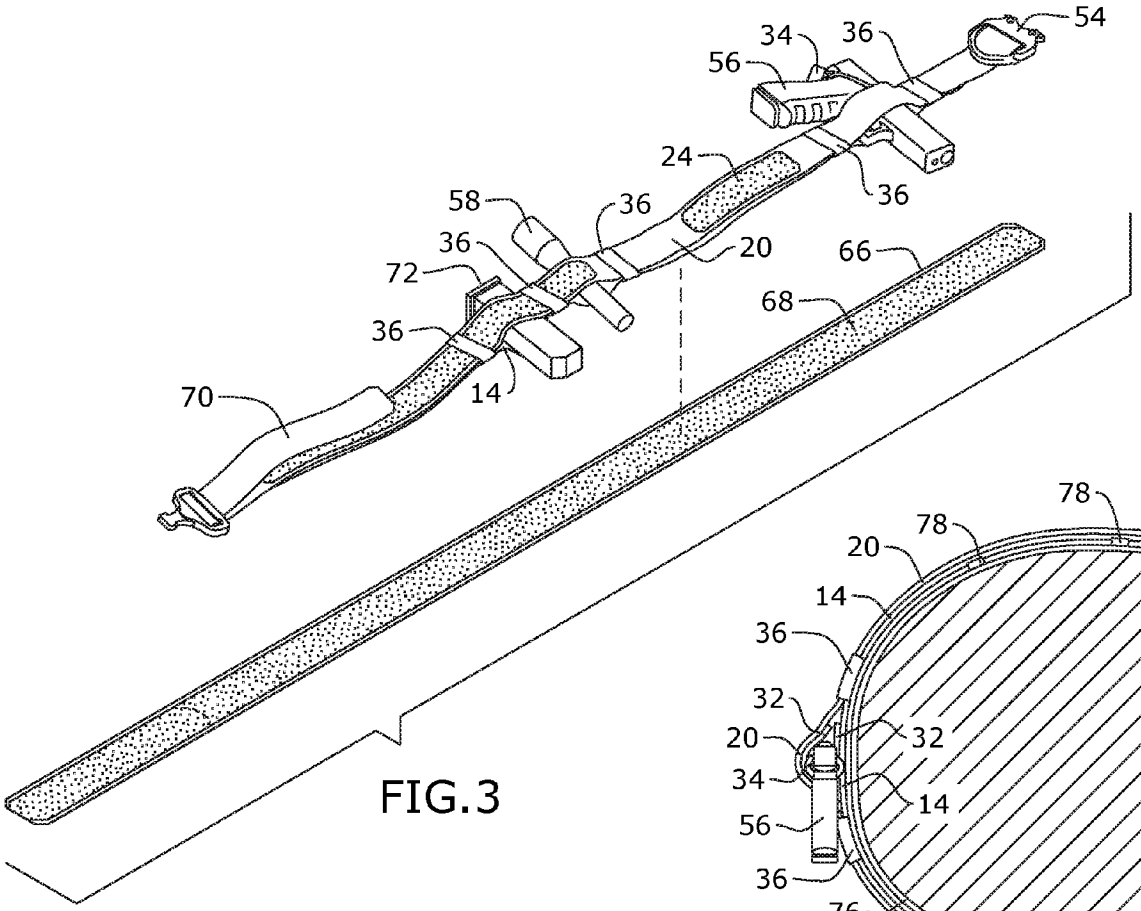
FIG. 3 is a partial exploded view of the tactical belt.
Figure 4:
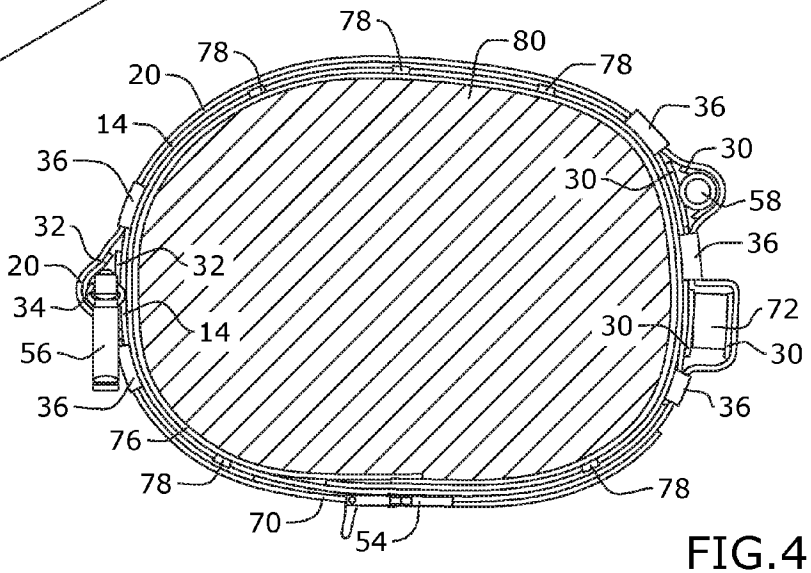
FIG. 4 is a section view of the tactical belt taken from 4-4 in FIG. 1.
Figure 5:
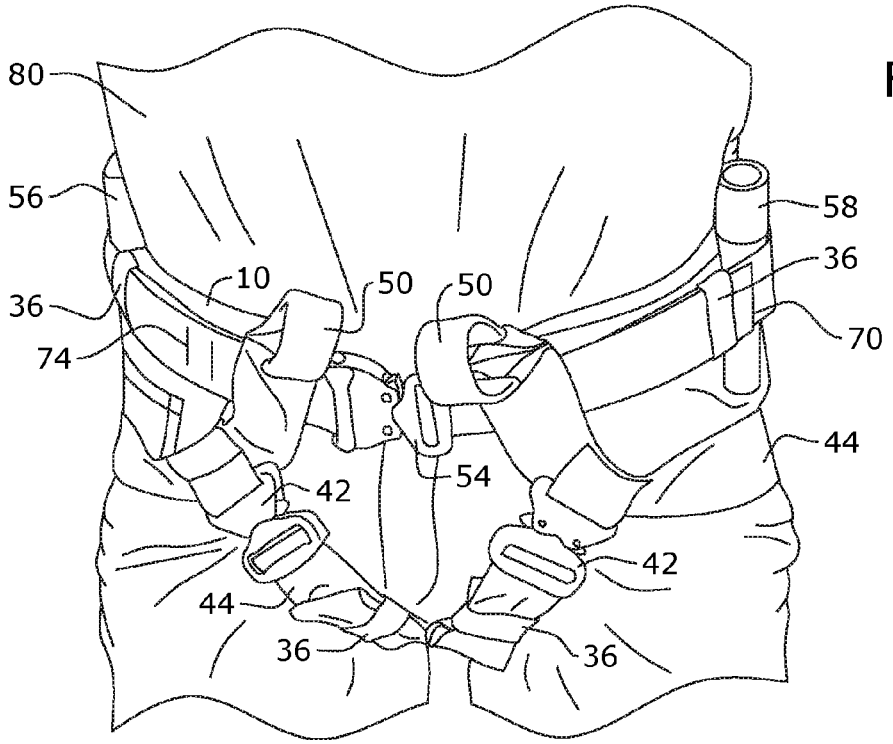
FIG. 5 is a front view of an alternate embodiment shown in use.
Figure 6:
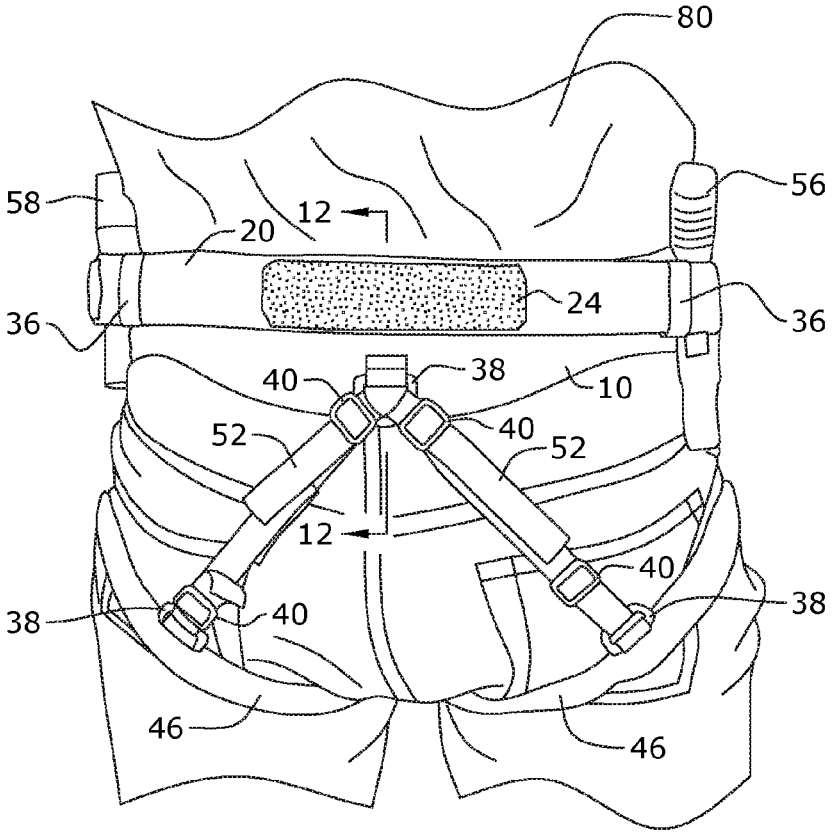
FIG. 6 is a back view of an alternate embodiment shown in use.
Figure 7:
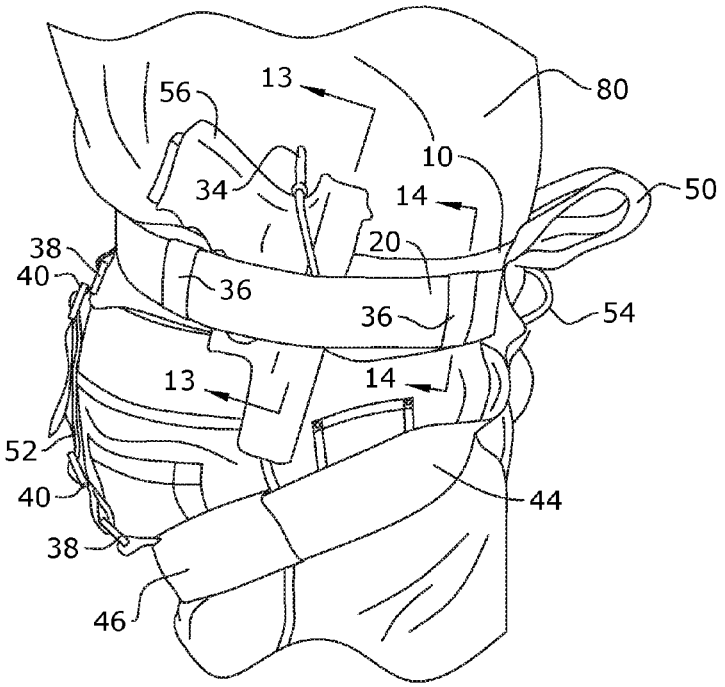
FIG. 7 is a side view of an alternate embodiment shown in use.
Figure 8:
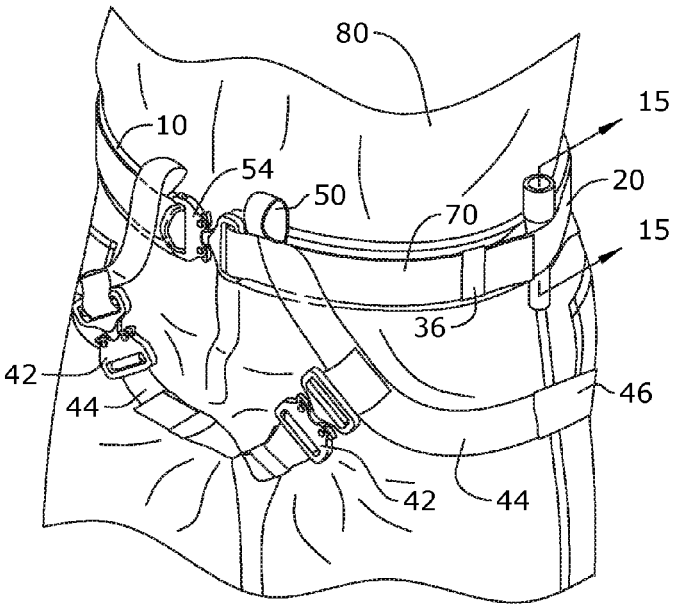
FIG. 8 is a front perspective view of an alternate embodiment shown in use.
Figure 9:
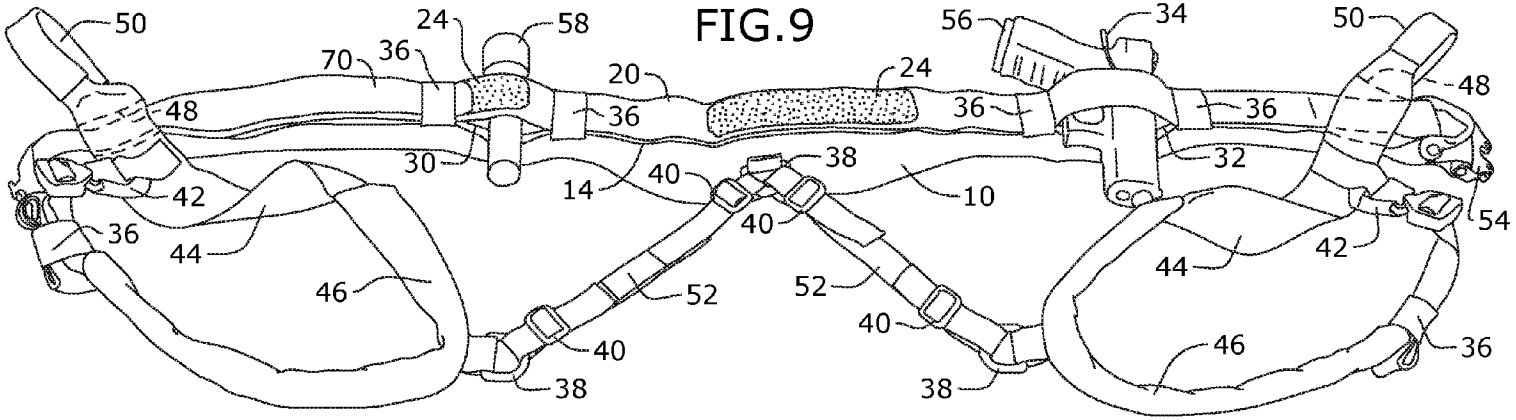
FIG. 9 is an exterior view of an alternate embodiment (lying flat).

As best seen in reference to FIGS. 3 and 4, the belt assembly 5 is formed of a plurality of layers, including an inner wrap belt 66, an outer belt 70, and an optional comfort belt 10. The inner wrap belt 66 is preferably formed of a nylon web material that is covered on at least one surface by a layer of one of a hook or a pile material 68. When donned by a user 80, the inner wrap belt 66 is threaded through a plurality of conventional belt loops 78 around the waistline of a pair of pants 76 worn by the user 80. The hook and pile material 68 of the inner strap 66 provides a mating surface for cooperative engagement with either an inner surface of the outer belt 70, or the optional comfort belt 10. Preferably, the inner wrap belt 66 is formed without a buckle assembly attached to its free ends.

The outer belt 70 is preferably formed of double layer of a nylon web material, having an inner web 14 and an outer web 20. The opposed faces of the inner web 14 and the outer web 20 have are provided with a fastener material, which may be one of a cooperating hook or pile material layer, such as Velcro®. The inner web 14 is provided with a first fastener material 18 along an outwardly facing surface (facing outwardly from the user's body when the belt is worn) of the inner web 14. The outer web 20 is provided with a cooperating layer of a second fastener material 22 along an inwardly facing surface (facing inwardly towards the user's body when the belt is worn) of the outer web 20. The first fastener material 18 joins with the second fastener material 22 in cooperative engagement such that the inner web 14 and outer web 20 are releasably joined as a single belt. The inner web 14 and outer web 20 may thus be separated at a desired location and to a desired size to define a retention point for the carriage of a tactical accessory.

The inner web 14 is also provided with a third fastener material 16 layer along an inwardly facing surface of the inner web 14. The third fastener layer 16 will have a layer selected to cooperatively engage with the fourth fastener material layer 68 provided along a length of the inner strap 66 in order to secure the outer belt 70 to the inner layer 66 and limit torsional or vertical movement of the belt assembly 5 about the user 80. This configuration allows for quick removal of sidearm(s) 56 and tactical accessories carried by the outer belt 70 by removing the entire outer belt 70 of the retention system at once. The ends of the outer belt 70 are fitted with an adjustable buckle assembly 54, which permits the user 80 to adjust the length of the outer belt 70. The outer belt 70 is preferably formed as a single length of double-looped Nylon Web.

The double loop configuration allows for customized placement and sizing of a retention point for sidearm 56 and other tactical accessories via a plurality of adjustable loops 36 that encircle the outer belt 70. The loops 36 are configured to slide along the length of the belt system 70. A pair of adjacent loops 36 may be positioned along the belt 70, thereby forming and sizing the retention point between loops 36. The user can remove and replace accessories (e.g. magazines, flashlights etc.) multiple times without re-sizing. This is because the friction created between the Nylon Tape loops 36 and belt 70 prevents unintentional changes in the size of the retention points. Once adjusted, the user will have to remove the belt in order to re-adjust retention points. This prevents any sidearm 56 or accessories from slipping out of, or not being easily returned to, the belt 70.

An outer portion of Nylon Web (3) is attached to the inner portion via Hook-Pile-Tape (2) sewn onto the interior portion. This allows both parts of the system to be firmly attached, and easily detached. The Cobra Buckle (1) secures both ends of the outer portion of the system.

Heavyweight Thread (5) attaches all of the portions of Hook-Pile-Tape (2), and reinforces the Tactical Retaining Belt in case the user must place his or her full weight onto the belt.

The optional comfort belt 10 includes a pad that avoids user 80 discomfort in situations in which the user 80 may place great weight or strain on the belt assembly 70, (e.g. climbing, rappelling, a fall etc.).

As seen in reference to FIGS. 5-9, an optional rappelling harness may be operatively coupled to the belt assembly 5. The rappelling harness includes, a leg strap 44 formed to encircle a user's leg. A first end of the leg strap 44 has hook loop 50 defined at the end thereof. The hook loop 50 may be formed by folding the first end of the leg strap 44 over itself, which may be stitched or otherwise joined at a first seam to form the hook loop 50. A belt slot 48 may be defined inwardly from the hook loop 50 and may be defined between the first seam and a second seam joining the free end of the leg strap 44 onto itself.

A back strap 52 is operatively connected between an aft portion of the leg strap 44, and a midpoint of the comfort strap 10. The aft strap 52 is adjustable in length via one or more square rings 40 adapted to receive the strap therein and provide a non-slipping securement of the back strap 52 under tension. The back strap 52 is connected to the leg strap 44 and the comfort strap 10 via one or more D-rings 38 operatively coupled via a loop of material sewn to the leg strap 44 and the comfort strap 10. A left and a right back strap 52 may be attached to a common D-ring operatively attached to the comfort strap 10.

A second end of the leg strap 44 is fitted with a buckle 42, such as a cobra buckle, and is configured for cooperative engagement with a corresponding buckle 42 operatively attached to an intermediate portion of the leg strap 44 proximal to the belt slot 48. The buckles 42 permit the user 80 to quickly secure the leg strap 40 around the legs, without the awkwardness of attempting to step through the loop formed by the leg strap. This allows for rapid preparation to climb or rappel, without the need of putting on a full harness. The leg strap 44 may also include a comfort cover 46, which may be formed as a padded sleeve to cover at least an aft portion of the leg strap 44. The user can adjust the leg straps 44 via a friction adapter for an individual, secure fit around thighs.

Figure 10:
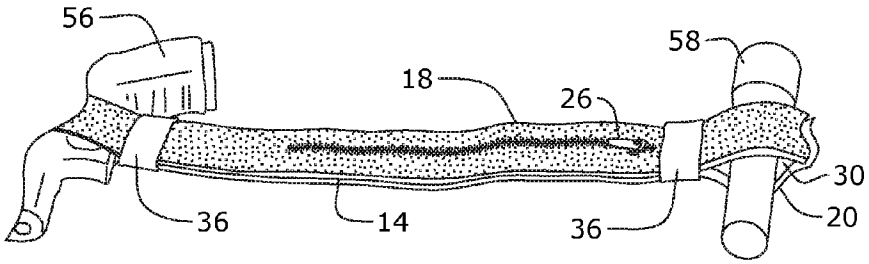
FIG. 10 is an enlarged view of the 14 illustrating the zipper.
Figure 11:
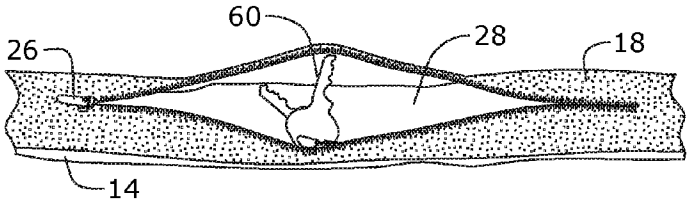
FIG. 11 is an enlarged view of the 26 unzipped.

As seen in reference to FIGS. 10 and 11, the belt assembly 5 may also be configured to solve the issue of concealment of sensitive items. The belt assembly, may be configured with a built-in compartment 28 formed by the layers of the outer belt 70. An opening is defined in a surface of the Velcro layer 18 and may be secured between an open condition and a closed condition via a zipper 26. The sensitive item compartment 28 may be sewn onto the worn side of the outer portion of the system, in the center of the belt 70. The compartment 28 may contain small articles, such as keys 60, identification cards, bank cards, or currency.

Figure 12:
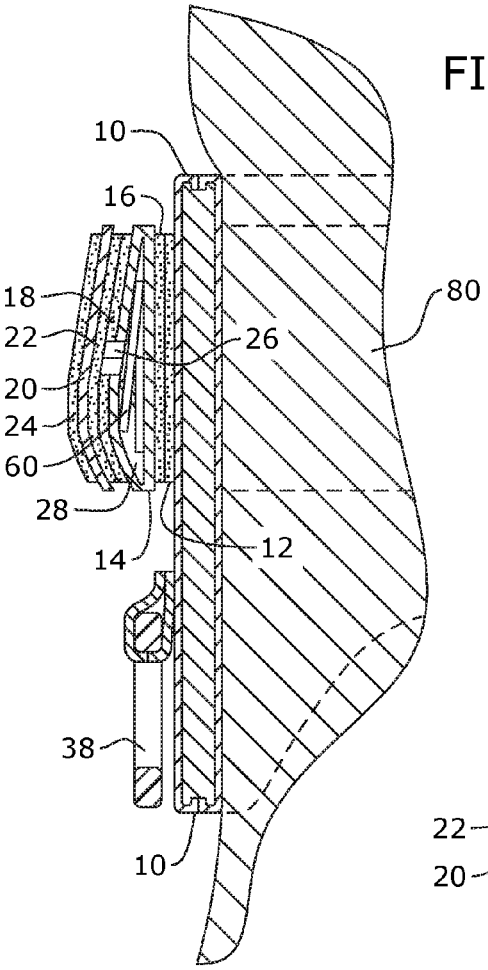
FIG. 12 is a section view of the tactical belt taken from line 12-12 in FIG. 6.

A detail sectional view of the comfort pad 10 and its relationship to the other layers of the belt assembly 5 is shown in reference to FIG. 12. The comfort pad 10 is positioned proximal to the back or lumbar spinal area of a user 80. An outer surface of the comfort pad 10 includes a layer of hook and pile fastener material 12 attached to and extending along the upper aspects of the comfort pad 10. The comfort pad fastener material 12 is configured to engage with a cooperating interior fastener layer 16 attached to the inner belt 14. The detail view shown illustrates the compartment 28 and the zipper 26 in an outer layer of the inner belt. An inner belt exterior fastener layer 18 is attached to an exterior surface of the inner belt 14 and is configured for cooperative engagement with an outer belt interior fastener layer 22 operatively attached to an interior surface of the outer belt 20. As previously indicated, the exterior surface of the outer belt 70 may also have an outer fastener layer 24 along certain portions of the outer belt 70. The D-ring 28 for attachment of the leg strap 52 is illustrated attached to an outer surface of the comfort pad 10 at a lower aspect thereof.

Figure 13:
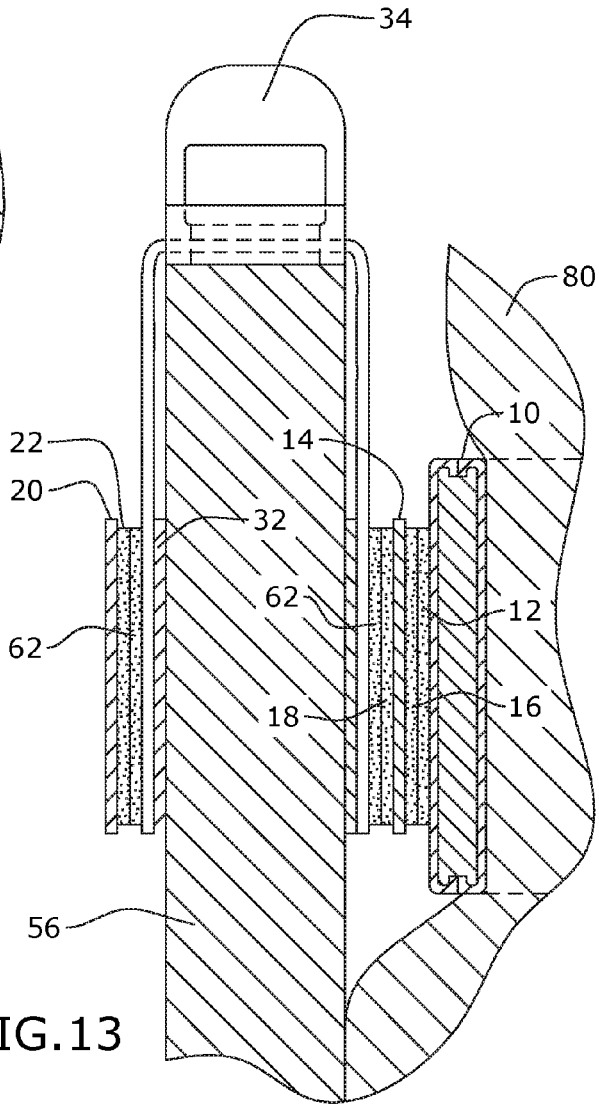
FIG. 13 is a section view of the tactical belt taken from line 13-13 in FIG. 7.

A detail sectional view of a holster opening for a firearm 56 is illustrated in reference to FIG. 13. The optional comfort pad 10 is positioned adjacent to the user's body 80. The comfort pad fastener layer 12 is shown attached to the comfort pad 10 and cooperatively couples to the interior fastener layer of the inner belt 14. A holster insert 32 has an outer surface having a fastener layer 62 that cooperatively engages with the exterior fastener layer 18 of the inner belt 14 and the outer belt interior fastener layer 22. The holster insert 32 defines a holster opening for receiving a portion of the firearm 56 therein. Referring again to FIG. 4, the holster insert 32 may have a substantially C-shaped clip. The holster insert 32 may be formed of a resilient plastic or metallic material. Alternatively, the holster insert 32 may be formed from the same web material as selected for the belts. The holster insert 32 may also be provided with a latch 34, which may be secured around the butt of the weapon 56 to retain the weapon 56 within the holster insert 32.

Figure 14:
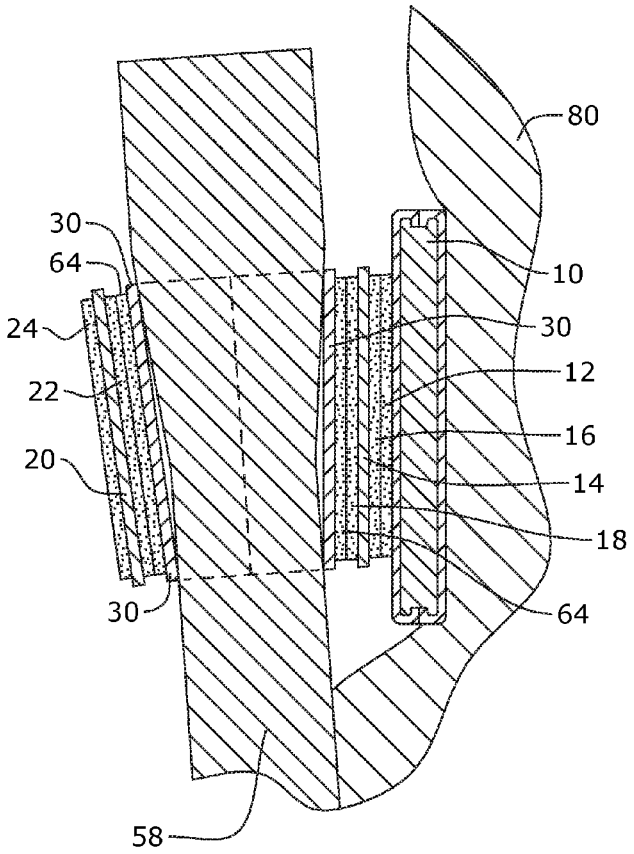
FIG. 14 is a section view of the tactical belt taken from line 14-14 in FIG. 7.

An embodiment of a slot insert 30, adapted to receive other tactical gear, such as a flashlight 58 is shown in reference to FIG. 14. The layers are depicted as previously described for the holster insert 32. In this instance the slot insert 30 has a fastener layer 64 on its outer surface. The fastener layer 64 is adapted for cooperative engagement with the exterior fastener layer 18 of the inner belt 14 and the outer belt interior fastener layer 22.

Figure 15:
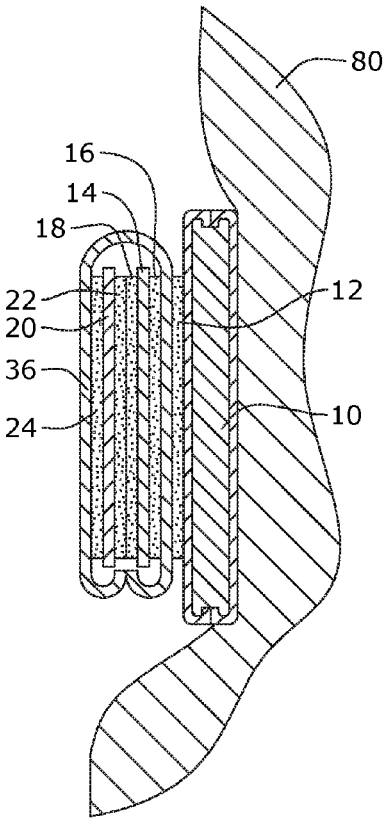
FIG. 15 is a section view of the tactical belt taken from line 15-15 in FIG. 8.

A detail sectional view of a loop 36 about the belt assembly 5 is illustrated in reference to FIG. 15. In this case, the interior surface of the loop 36 is positioned adjacent to the comfort pad fastener layer 12. The loop 36 encircles the inner belt 14 and the outer belt 20 and their associated fastener layers. The loop 36 may be formed from a nylon web material that is stitched into a solid loop via reinforced stitching.

As will be appreciated, in the regions between adjacent loops 36, that do not form a retention point, the exterior fastener layer 18 of the inner belt 14 cooperatively engages with the interior fastener layer 22 of the outer belt layer 20 to maintain the inner belt 14 and the outer belt 20 in an attached relation. In the regions between adjacent loops 36, with an insert, the retention points may be as described in the foregoing.

The Nylon Web of the straps may be joined via stitch to the Hook-Pile-layers with a heavyweight thread along the portions designated. The reinforcement stitches may be placed with a high-speed, bar tacking machine. The D-rings and Cobra Buckle may be permanently secured via three rows of bar tack stitches on the right-hand portion, and by friction adapter on the left hand side. The friction adapter may be kept in place via a reinforced bar tack stitch.

In donning the belt assembly 5, prior to securing the Cobra buckle, the Nylon Tape loops 36 are slid down the belt, thus allowing the user to create retention points along the belt 5. The nylon tape is stitched into a solid loop via reinforced stitching. In between the two levels of Nylon Web on the outer belt there are one-sided portions of Hook-Pile-Tape in order to avoid sticking/retention issues for the user.

Additionally: This invention could be utilized by anyone that needs to carry handheld equipment. For example, carpenters, electricians, mechanics, etc. all require hand-tools. This belt can be used to retain any type of handheld devices or tools. The Tactical Retaining Belt is not limited to tactical purposes only, and may be utilized for recreational purposes, such as camping, rappelling, rock climbing, and a myriad of other activities.

It should be understood, of course, that the foregoing relates to exemplary embodiments of the invention and that modifications may be made without departing from the spirit and scope of the invention as set forth in the following claims.

What is claimed is:

1. A tactical belt comprising:

an outer belt having an inner web and an outer web, a first fastener layer attached to an outwardly facing surface of the inner web, a second fastener layer attached to an inwardly facing surface of the outer web, wherein the first and second fastener layers are releasably joined;

an inner belt having a fourth fastener layer along an outwardly facing surface thereof for cooperative engagement with a third fastener layer along an inwardly facing surface of the inner web of the outer belt, wherein the inner belt is adapted to be threadingly received through a belt loop of a user's pants; and a buckle to join a first end and a second end of the outer belt.

2. The tactical belt of claim 1, further comprising:

an insert having at least one sidewall defining a cavity therein; and a fastener layer attached to an exterior surface of the at least one sidewall, the fastener layer adapted to be received in a retention point defined between a separated portion of the inner web and the outer web.

3. The tactical belt of claim 2, wherein the insert is adapted to receive a tactical accessory.

4. The tactical belt of claim 2, wherein the insert is adapted to releasably retain a handgun.

5. A tactical belt, comprising:

an outer belt having an inner web and an outer web, a first fastener layer attached to an outwardly facing surface of the inner web, a second fastener layer attached to an inwardly facing surface of the outer web, wherein the first and second fastener layers are releasably joined;

an inner belt having a fourth fastener layer along an outwardly facing surface thereof for cooperative engagement with a third fastener layer along an inwardly facing surface of the inner web of the outer belt;

a comfort pad having a fastener material attached to and extending along an upper aspects of the comfort pad, wherein the comfort pad fastener material is configured to engage with a cooperating interior fastener layer attached to an outer surface of the inner belt, and a buckle to loin a first end and a second end of the outer belt.

6. The tactical belt of claim 5, further comprising:

a harness assembly having a pair of leg straps forming a releasable loop adapted to encircle a user's leg and operatively attachable to the outer belt via a hook loop defined at a first end of the leg straps.

7. The tactical belt of claim 5, wherein the leg straps further comprise a buckle to releasably join a second end of the leg straps at a point proximal the hook loop.

8. The tactical belt of claim 7, wherein the harness assembly further comprises:

a back strap operatively connected between an intermediate portion of the leg strap and a midpoint of the comfort strap.

9. The tactical belt of claim 8, wherein the back strap is adjustable in length via one or more square rings.

10. The tactical belt of claim 9, wherein the back strap is connected to the leg strap and the comfort strap via one or more D-rings operatively coupled via a loop of material sewn to the leg strap and the comfort strap.

11. The tactical belt of claim 10, wherein the leg straps are attached to a common D-ring operatively attached to the comfort strap.

12. The tactical belt of claim 11, wherein the second end of the leg strap is fitted with a buckle and is configured for cooperative engagement with a corresponding buckle operatively attached to an intermediate portion of the leg strap proximal to the belt slot.

13. The tactical belt of claim 12, further comprising:

a comfort cover formed as a padded sleeve to cover at least an aft portion of the leg straps.

* * * * *